United States Patent [19]

Martinez

[11] Patent Number: 4,477,005

[45] Date of Patent: Oct. 16, 1984

[54] PORTABLE, HAND-MOUNTABLE DEFENSE WEAPON SYSTEM

[76] Inventor: Louie Martinez, P.O. Box 34943, San Antonio, Tex. 78233

[21] Appl. No.: 387,593

[22] Filed: Jun. 11, 1982

[51] Int. Cl.[3] ..... B65D 85/20

[52] U.S. Cl. ..... 224/218; 224/249

[58] Field of Search ..... 224/218, 222, 229, 251, 224/191, 240, 200, 219, 249, 267, 901; 222/635; 24/10 R; 206/317

[56] References Cited

U.S. PATENT DOCUMENTS

| | | | |
|---|---|---|---|
| Re. 13,596 | 7/1913 | Van Valkenburg | 24/10 R |
| 1,199,635 | 9/1916 | Urmston | 224/218 |
| 4,214,677 | 7/1980 | Bauer et al. | 222/635 |
| 4,389,806 | 6/1983 | Herring | 224/240 X |
| 4,399,934 | 8/1983 | Dupont | 224/240 X |

*Primary Examiner*—Steven M. Pollard

*Assistant Examiner*—David Voorhees

*Attorney, Agent, or Firm*—Gunn, Lee & Jackson

[57] ABSTRACT

The present invention is a portable, hand-mountable defense weapon system which combines an aerosol container of tear gas propellant with an especially adapted carrier means. Carrier means has a singular pocket formed between the surfaces of the carrier which snugly retains the aerosol container without the need of any additional closure or retention means. The system is constructed such that it may be mounted with the aerosol container positioned such that the discharge means for discharging the tear gas is juxtaposed to the thumb of the user's hand for immediate use in case of attack upon the user. The system is fastened to the user's hand by a suitable fastener means. The flexible carrier means is less than 2" in width so that it may fit in the user's palm between the base of the fingers and the thumb.

1 Claim, 5 Drawing Figures

PORTABLE, HAND-MOUNTABLE DEFENSE WEAPON SYSTEM

BACKGROUND AND PRIOR ART

The present invention relates to a portable, hand-mountable defense weapon system particularly suitable for utilization by joggers and pedestrians.

As more individuals are becoming aware of the physiological and psychological health benefits obtained from an exercise program which incorporates walking, jogging, and running, more individuals are going outdoors for their exercise. Because the exerciser finds it cumbersome to carry some type of defensive weapon while exercising, such exercisers have become easy targets for muggers, thieves, and rapists. This defenseless condition is particularly a problem for women.

To protect themselves, certain joggers have begun to attach to the outside of their running outfit an aerosol container of tear gas propellant which can be detached and utilized if the jogger is attacked. These currently existing systems are less effective than the present invention, in that they must be detached from the outfit and then aimed at the attacker. The time loss in detaching and aiming such systems can be critical in effectively defending oneself. Further, while such systems could be hand-held during the exercise period, the user must consciously hold on to the system and does not have the free use of the hand holding the system. As the exercise period is extended, the exerciser becomes fatigued and finds it more difficult to continue to hold the system. (Frankly, most joggers and runners do not like to hold anything in their hands when running.)

Aerosol containers similar to that described above have been inserted into small holster-like carriers which function as key chains for use by pedestrians traveling to and from their homes or vehicles. However, like other hand-held systems, these devices suffer from the shortcomings previously discussed in that the hand holding such system is not free for other uses and may become fatigued.

U.S. Pat. No. Des. 255,509 discloses a wrist purse to be worn by the user to carry his or her keys, money, identification card and/or important papers. U.S. Pat. No. Des. 255,509, however, does not disclose the use of such a device in combination with an aerosol container of tear gas propellant to function as a defense weapon system. The design shown in the above cited patent is for a wrist purse, and if such an item were significantly modified to enable the user to insert an aerosol container of tear gas propellant, the device would be worn on the wrist, necessitating the use of the other hand to operate the discharge means of the container. Further, the design and device shown in the cited patent discloses a zippered compartment having an opening extending horizontally along the face or length of the device, rather than a nonzippered, vertical opening in the present invention. Should an attempt be made to use the device of U.S. Pat. No. Des. 255,509 to carry an aerosol container, the container would not be properly oriented for immediate, effective use during an attack.

The present invention does not suffer the shortcomings outlined with the prior art discussed above. The present invention presents a novel and non-obvious way to overcome the difficulties and deficiencies of the prior art.

SUMMARY OF PRESENT INVENTION

The present invention is a portable, hand-mountable defense weapon system which combines an aerosol container of tear gas propellant with an especially adapted flexible carrier means. The carrier means has a singular pocket formed between the surfaces of the carrier which snugly retains the aerosol container without the need for any additional closure or retention means. The system is constructed such that it may be mounted with the aerosol container positioned such that the discharge means for discharging the tear gas is juxaposed to the thumb of the user's hand for immediate use in case of an attack upon the user. The system is fastened to the user's hand by a suitable fastener means. The flexible carrier means is not larger than 2" in width so that it may fit in the user's palm between the base of the fingers and the thumb.

It is the object of the present invention to provide a defense weapon system which can be mounted in the palm of the user's hand, but which does not require the user to actually hold the device. Such an object allows the user to have full mobility of his or her fingers.

It is an object of the invention to provide a defense weapon system capable of utilizing a wide range of sizes of containers of tear gas propellant.

It is an object of the present invention to provide the user with a readily accessible protection system when the user is too tired to hold a weapon.

It is yet another object of the present invention to provide the user of the present invention with a discharge means properly oriented for quick use in case of attack. The present invention may be mounted on either the right or left hand.

BRIEF DESCRIPTION DRAWINGS

FIG. 1 - A perspective view of the invention mounted on a hand and being discharged.

FIG. 2 - A perspective view of the carrier means of invention.

FIG. 3 - A top view of the invention.

FIG. 4 - A side view of the invention.

FIG. 5 - A bottom view of the invention.

DETAILED DESCRIPTION OF THE PREFERRED EMBODIMENT

Figure 1:
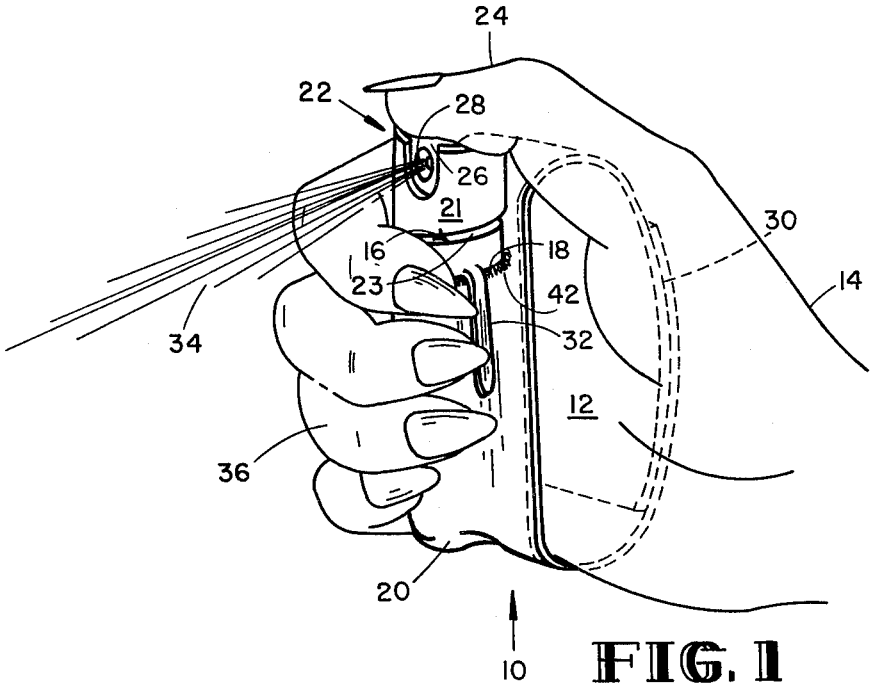

FIG. 1 shows the preferred embodiment of the present invention 10 mounted in the palm 12 of the user's hand 14 between the base of the fingers 36 and the thumb 24. As can be seen in FIG. 1 an aerosol container of tear gas propellant 16, preferably containing active ingredient orthochlorobenzalmalononitrate military cs tear gas, is retained within an open pocket of flexible carrier means 20.

The present invention 10 is orientated on the user's hand such that the container 16 having a discharge means 22 is juxtaposed to the user's thumb 24. The discharge means contains a discharge button 26 and a discharge nozzle 28. Container 16 also has a cylindrical cap member 21 and a cylindrical body portion 23. The present invention 10 is secured to the hand 14 by fasteners means 30 which attaches at the back of the user's hand.

While container 16 fits snugly into appropriately sized open pocket 18, a supplementary retention means 32 is shown adapted to be attached to container 16 in FIG. 1. Supplementary retention means 32 in FIG. 1 is a spring-type clip commonly known in the art. Supplementary retention means 32 is rotatably attached to body portion 23 of container 16 such that discharge nozzle 28 may be orientated such that depression of discharge button 26 results in a tear gas spray 34 being sprayed forward of the user's hand. Once the proper orientation has been established, retention means 32 holds container 16 in such orientation.

As can be seen from FIG. 1, if the user's fingers 36 are relaxed and not in contact with invention 10, invention 10 remains mounted and appropriately oriented in the user's palm 12 with fastener means 30 attached at the back of the user's hand.

Figure 2:
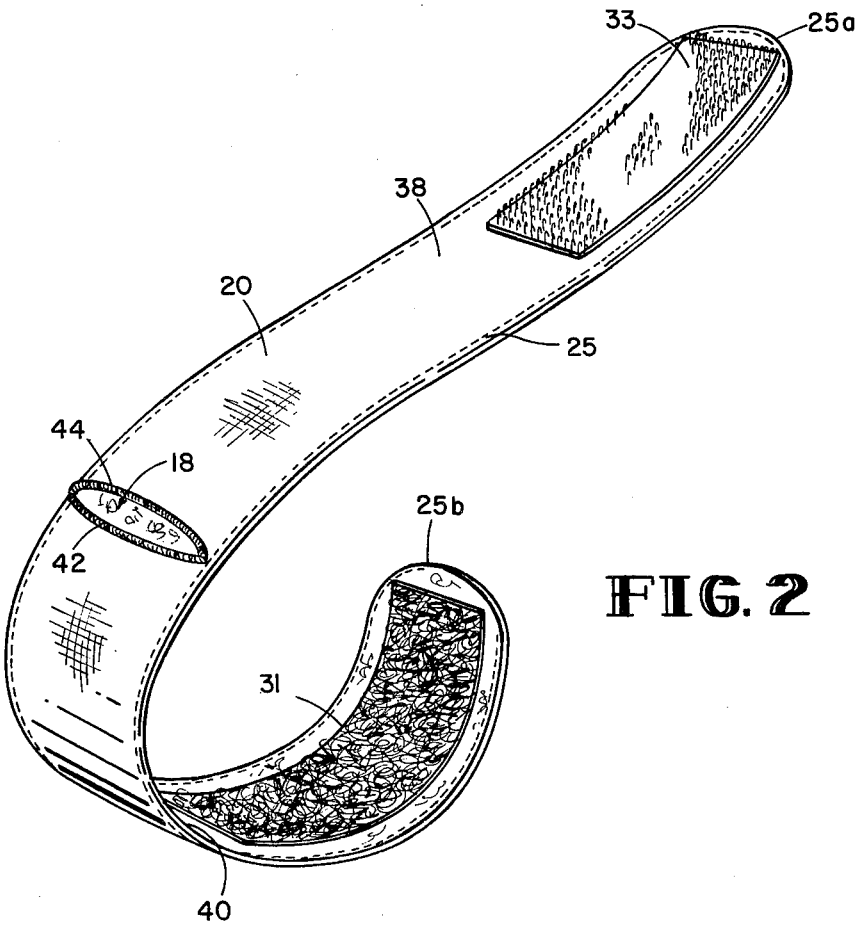

FIG. 2 is a perspective view of invention 10 illustrating that carrier means 20 has a top surface 38 and an underside 40. Top surface 38 is constructed from a washable fabric material and in the preferred embodiment is nylon. Underside 40 is constructed from a second piece of washable fabric material having more moisture absorbency characteristics. In the preferred embodiment underside 40 is terry cloth cotton.

Top surface 38 and underside 40 are connected along the outside edge of the two pieces by sewing or other adhesive means known in the art. The width of top surface 38 and underside 40 in the preferred embodiment is approximately 1 7/16" but in all cases less than 2". A single stich of nylon thread is sewn along the entire length and width of top surface 38 and underside 40 after they are placed on each other. Approximately 1/16" border 25 is thus formed around carrier means 20.

FIG. 2 illustates that open pocket 18 is formed between the top surface 38 and the underside 40 of carrier means 20 with the edge of the pocket opening 42 extending vertically across the face of top surface 38, i.e., extending across the width of top surface 38. As can be seen in FIG. 2, opening 42 is provided with reinforced stitching 44, commonly called "button hole" stitching, to provide additional strength in retaining container 16 within pocket 18. Pocket 18 is capable of accepting container 16 and opening 42 is approximately 1 3/16" in the preferred embodiment.

In the preferred embodiment the diameter of body portion 23 of container 16 is approximately 7/16" while the cap member 21 is approximately ½" in diameter. The slight difference in diameter insures that container 16 does not extend into pocket 18 beyond cap member 21, thereby covering discharge nozzle 28.

Fastening means 30 (FIG. 1) is constructed from synthetic materials which will adhere when pressed together. A commonly known brand name for such fasteners is Velcro. Such fastener means are complimentary in nature with a first portion 31 attached to underside 40 of flexible carrier 20 and a second portion 33 of the fastener connected to top surface 38.

As can be seen in FIG. 2, pocket opening 42 is generally located in a middle location along top surface 38 with the second portion 32 of fastener means 30 at one end of the top surface 38. First portion 31 of fastener means 30 is located on the underside 40 of carrier 20 at an end opposite the location of the second portion 33 of fastener means 30.

Figure 3:
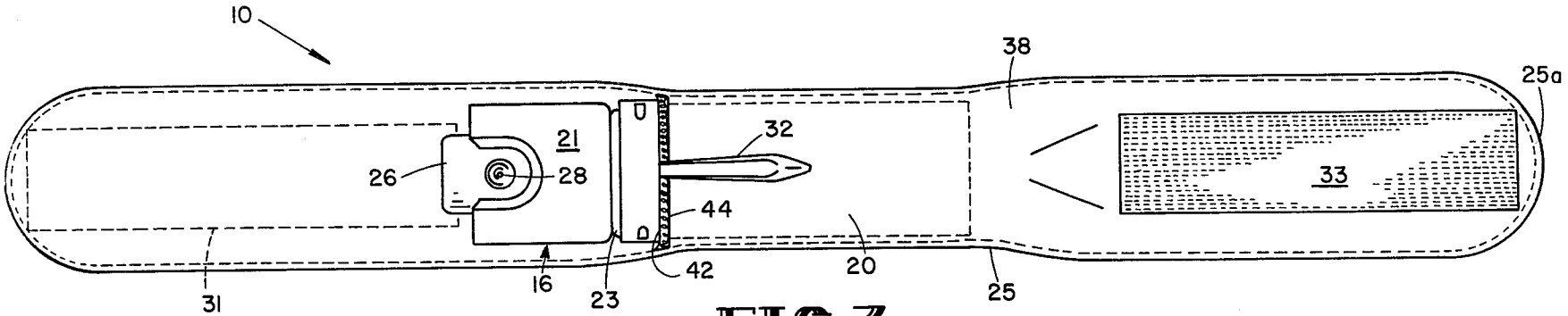

A top view of the present invention is shown in FIG. 3. The preferred embodiment is approximately 12" in length and 1 7/16" in width. The present invention should be less than 2" in width to facilitate mounting within the user's palm. FIG. 3 shows that on generally the right of the carrier 20 is second portion 33 of fastener means 30. In the preferred embodiment, second portion 33 is approximately ¾" in width and approximately 3-⅜" in length. The rightmost width edge of portion 33 abuts the right width border **25*a* on carrier means 20. Situated at a generally middle location along top surface 38 can be seen pocket opening 42. In the preferred embodiment the leading edge of pocket opening 42 is situated approximately 4-¾" from the left side of top surface 38 as seen in FIG. 3. Opening edge 42 is provided with reinforced stitching 44 (button hold stitching) to provide strength and to reduce fraying of opening edge 42 during exchange of container 16. FIG. 3 also shows that the pocket opening 42 extends vertically across the face or width of top surface 38. Further, FIG. 3 illustrates that both the right and left width edges of carrier means 20** are curved rather than straight.

Figure 4:
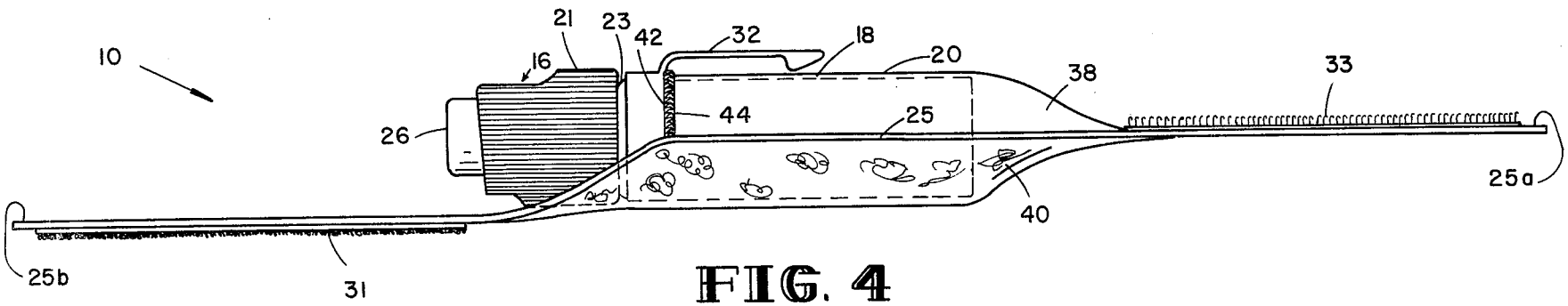

The side view of invention 10 can be seen in FIG. 4. Container 16 is snugly fit within pocket 18 which is sized such that container 16 barely fits within pocket 18.

Because cap member 21 is slightly larger than body portion 23, as previously discussed, container 16 does not extend so far into pocket 18 such that discharge nozzle 28 is covered.

By utilizing a container 16 with a cap member 21 larger than the body portion 23, there is no need to form a bottom into pocket 18 other than that resulting from the border stitching previously discussed. Thus, containers with a wide range of lengths of body portions may be used interchangeably in the present invention.

FIG. 4 further discloses the location of the first portion 31 of fastener means 30 situated at the left end of underside 40 relative to second portion 33 of fastener means 30 located at the right end of top surface 38. In the preferred embodiment first portion 31 is approximately ¾" in width and approximately 3-⅜" in length. The leftmost edge of first portion 31 abuts left width border **25*b* on carrier means 20**.

Figure 5:
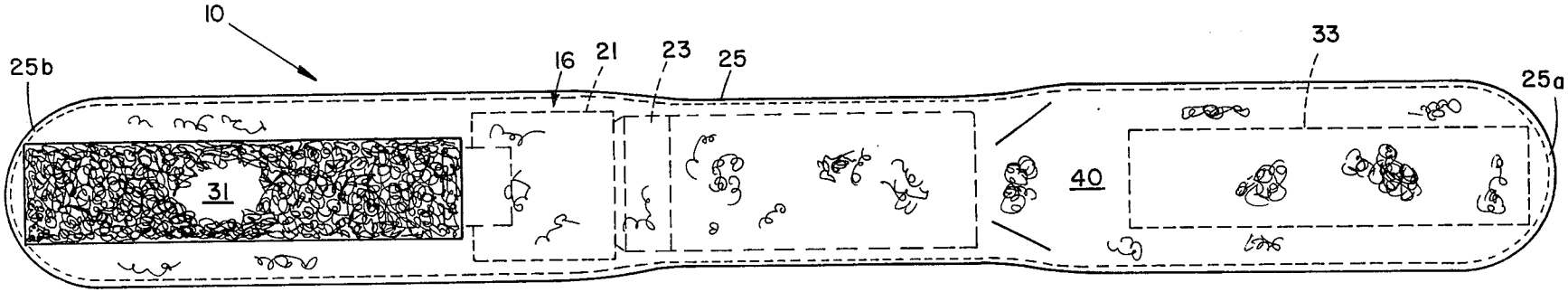

FIG. 5 is a back view of invention 10 showing the position of first portion 31 of fastener means 30 attached to the left end of underside 40 of carrier means 20. Both first portion 31 and second portion 33 of fastener means 30 are attached to flexible carrier means 20 either by sewing or by use of suitable adhesive means, known in the art. In the preferred embodiment, a single stitch of nylon thread is utilized along the edge of the entire length and width of both first portion 31 and second portion 33 of fastener means 30 but is not shown in the drawings.

While the invention has been described in connection with the preferred embodiment, it is not intended to limit the invention to the particular form set forth; but, on the contrary, it is intended to cover alternatives, modifications, and equivalents that may be included within the scope of the invention as defined by the appended claims.

I claim:

1. A portable, hand-mountable, defense weapon system comprising:

(a) a flexible carrier means having a singular open pocket with an opening extending laterally across less than the full width of a first surface, said first surface above a second independent surface, said surfaces joined together along the edges of said surfaces, said surfaces having said pocket formed therein at a generally middle location between said surfaces, said first surface having adapted thereto adjacent one end of said first surface a first portion of a complimentary fastening means adapted to be releasably engaged with a corresponding second portion of said complimentary fastening means adapted adjacent an opposite end of said second surface, wherein upon engagement of said first portion with said second portion said system is securely retained in place on a user's hand;

(b) an aerosol container of tear gas propellant having a cylindrical body portion sized to be securely retained within said pocket without the aid of any attachment means during movement of said system, said container having a cylindrical cap member being larger in diameter than said cylindrical body portion of said container, said container further having a discharge means in said cap extending above said opening in said pocket when said container is disposed within said pocket, said discharge means further being juxtaposed to the thumb of said hand such that said thumb may operatively engage said discharge means discharging said gas away from said hand when said complimentary fastening means is engaged, securely retaining said system on said hand.

* * * * *